US006561402B2

(12) United States Patent
Holland et al.

(10) Patent No.: US 6,561,402 B2
(45) Date of Patent: May 13, 2003

(54) AMBIDEXTROUS DRILL HOLSTER

(75) Inventors: Matthew J. Holland, Baltimore, MD (US); Gregory Scott Snider, Bel Air, MD (US); James Pangerc, Parkville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/850,404

(22) Filed: May 8, 2001

(65) Prior Publication Data

US 2002/0003155 A1 Jan. 10, 2002

Related U.S. Application Data

(60) Provisional application No. 60/204,463, filed on May 16, 2000.

(51) Int. Cl.[7] ..... F41C 33/02; F41C 33/04

(52) U.S. Cl. ..... 224/677; 224/192; 224/242; 224/680; 224/901.4; 224/911; 224/904

(58) Field of Search ..... 224/192, 193, 224/236, 238, 243, 677, 680, 904, 911, 242, 901.4

(56) References Cited

U.S. PATENT DOCUMENTS

| | | | | |
|---|---|---|---|---|
| 918,837 | A | | 4/1909 | Fisher |
| 3,011,687 | A | | 12/1961 | Boyt |
| 3,118,580 | A | | 1/1964 | Manshel |
| 3,533,540 | A | | 10/1970 | Carinci |
| 3,707,250 | A | | 12/1972 | Esposito |
| 4,079,870 | A | * | 3/1978 | Clark ..... 224/911 |
| 4,312,466 | A | | 1/1982 | Clark |
| D291,389 | S | | 8/1987 | Crymes |
| 4,779,655 | A | | 10/1988 | Olson |
| 4,828,154 | A | | 5/1989 | Clifton, Jr. |
| 4,917,281 | A | | 4/1990 | Ostermiller |
| 4,966,321 | A | | 10/1990 | Outlaw |
| D333,215 | S | | 2/1993 | Brown |
| 5,199,620 | A | | 4/1993 | Beletsky |
| 5,246,153 | A | | 9/1993 | Beletsky |
| 5,269,448 | A | | 12/1993 | Shoemaker |
| 5,388,740 | A | | 2/1995 | Garland |
| 5,568,889 | A | | 10/1996 | Holloway, Jr. et al. |
| 5,865,357 | A | | 2/1999 | Goodwin |
| 5,984,046 | A | | 11/1999 | Urso, Jr. |
| 6,065,658 | A | | 5/2000 | Hashimoto |

FOREIGN PATENT DOCUMENTS

| | | |
|---|---|---|
| DE | 8704878.7 | 6/1987 |
| DE | 29918950 U1 | 1/2000 |
| EP | 0919157 A2 | 6/1999 |

* cited by examiner

*Primary Examiner*—Stephen P. Garbe
(74) *Attorney, Agent, or Firm*—Harness, Dickey & Pierce, P.L.C.

(57) ABSTRACT

An ambidextrous drill holster is provided which enables the drill holster to be accessible for both a left handed or a right handed user. A reinforcement type material is also provided for strengthening the tool belt pass-through neck of the weight bearing pouch.

16 Claims, 8 Drawing Sheets

AMBIDEXTROUS DRILL HOLSTER

CROSS-REFERENCE TO RELATED APPLICATIONS

This application claims the benefit of U.S. provisional application Ser. No. 60/204,463 filed May 16, 2000.

FIELD OF THE INVENTION

The present invention relates generally to weight bearing pouches used with a workbelt and more particularly to an ambidextrous drill holster for use with a work belt.

BACKGROUND OF THE INVENTION

The ability to have a flexible and easy to use holster has been in demand for many years. Various types of weight bearing holsters have been designed to provide convenience and adaptability to various user needs. The adaptability of the holsters provides easy access for different tools. The weight bearing holsters are typically designed with a belt-loop configuration, allowing the holster to be placed on a work or tool belt. In general, tool belts contain a variety of weight bearing pouches or holsters that provide easy accessibility to the user.

Tool belts have been used in the construction industry for many years by carpenters, construction workers, electricians, and plumbers. Specially designed holsters have been utilized for various types of tools which are hung by the tool belt.

In particular, the widespread use of cordless drills has led to the need for improved drill holsters. One of the problems with a drill holster is that it has typically been designed specifically for a right-handed or a left-handed user, and was not adaptable for use by both a right and a left-handed user.

SUMMARY OF THE INVENTION

Accordingly, the present invention provides an ambidextrous drill holster which enables the drill to be accessible for both a left handed or a right handed user. The object of the present invention is to provide a user friendly tool holster that is easily adaptable to various users.

The present invention further provides a reinforcement type material for strengthening the tool belt pass-through neck of the weight bearing pouches. As pouches hang from a tool belt, the extra weight bearing material provides needed reinforcement to an area that is susceptible to premature failure. The present invention increases not only the accessibility but the durability of the holster.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

With reference to the accompanying figures, the weight bearing pouch, more particularly an ambidextrous drill holster, used with a workbelt according to the present invention, will now be described.

Figure 1:
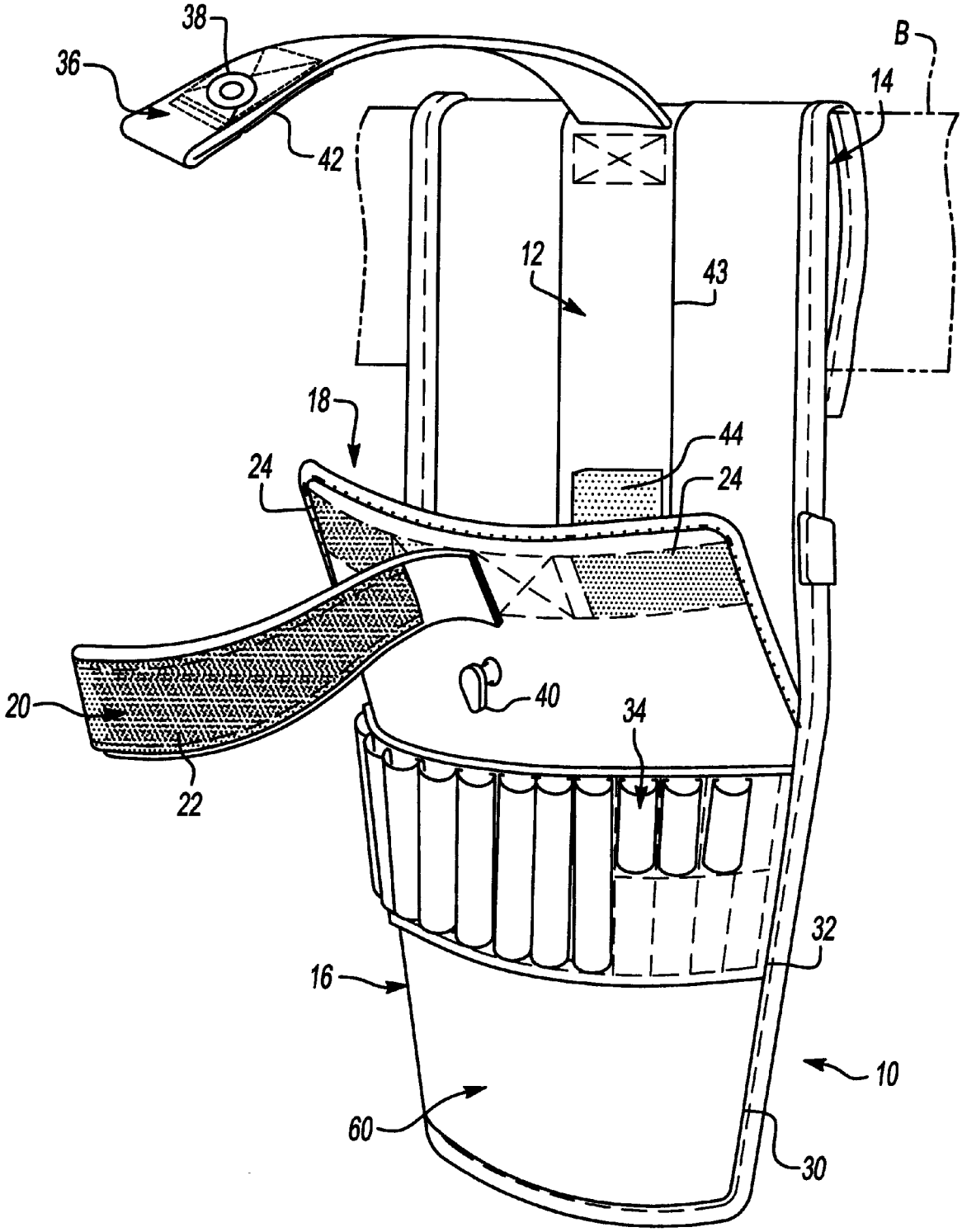
FIG. 1 is a perspective view of a drill holster according to the principles of the present invention.

With reference to FIG. 1, the drill holster 10 includes a backing 12 which forms a belt loop 14 through which a belt B (shown in phantom) may pass through for securing the drill holster 10 to the belt B. The backing 12 is preferably made of nylon or leather, although various materials can be used to construct the backing.

A pocket 16 is sewn to the backing 12 for forming a pocket-like receptacle for receiving a drill or any other type of tool or device that is desirably secured within a holster. The pocket 16 is preferably made of nylon or leather, although various materials can be used during the manufacturing process.

Figure 2A:
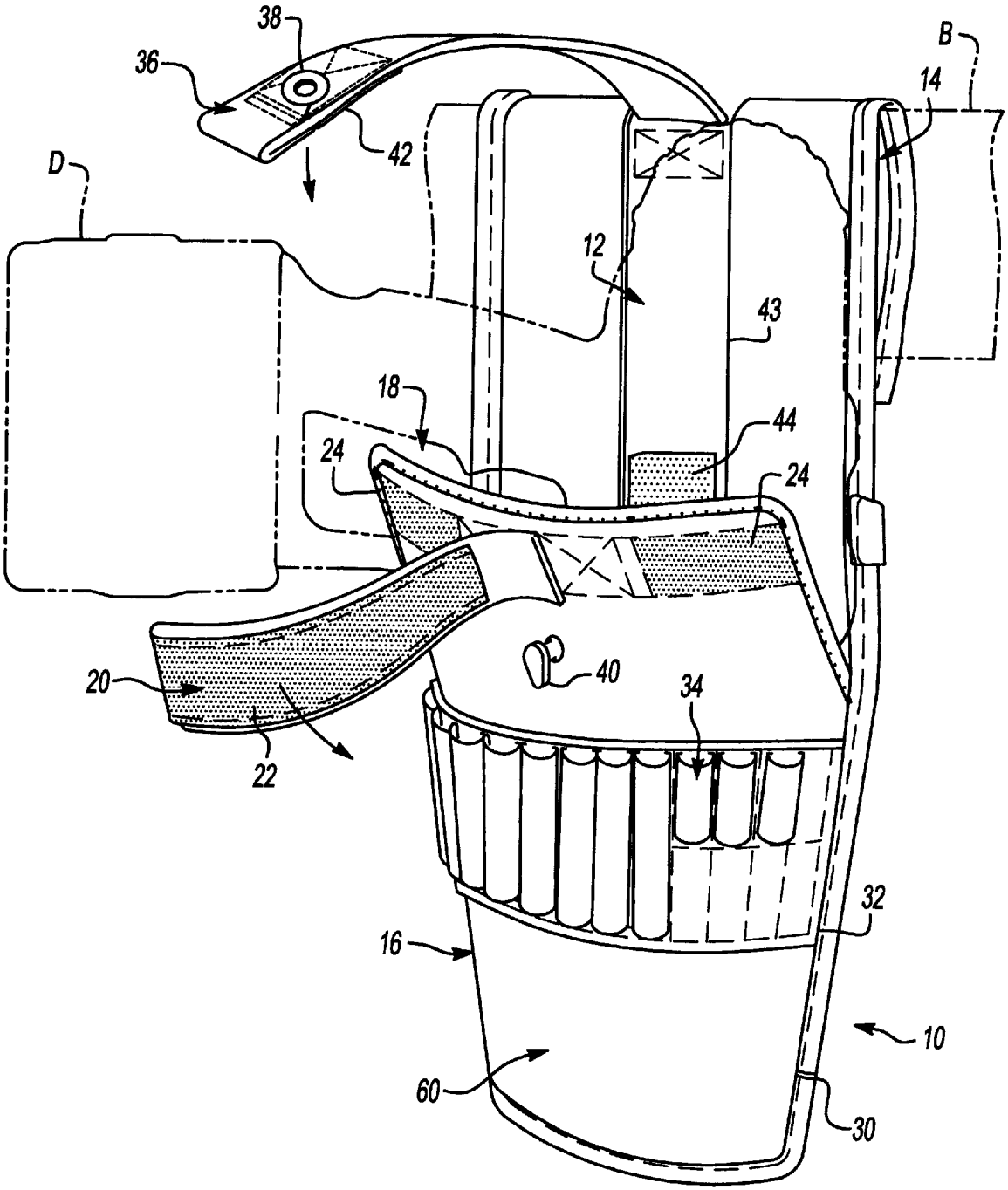
FIG. 2*a* is a perspective view of a drill holster accommodating a right-handed orientation of a drill.
Figure 2B:
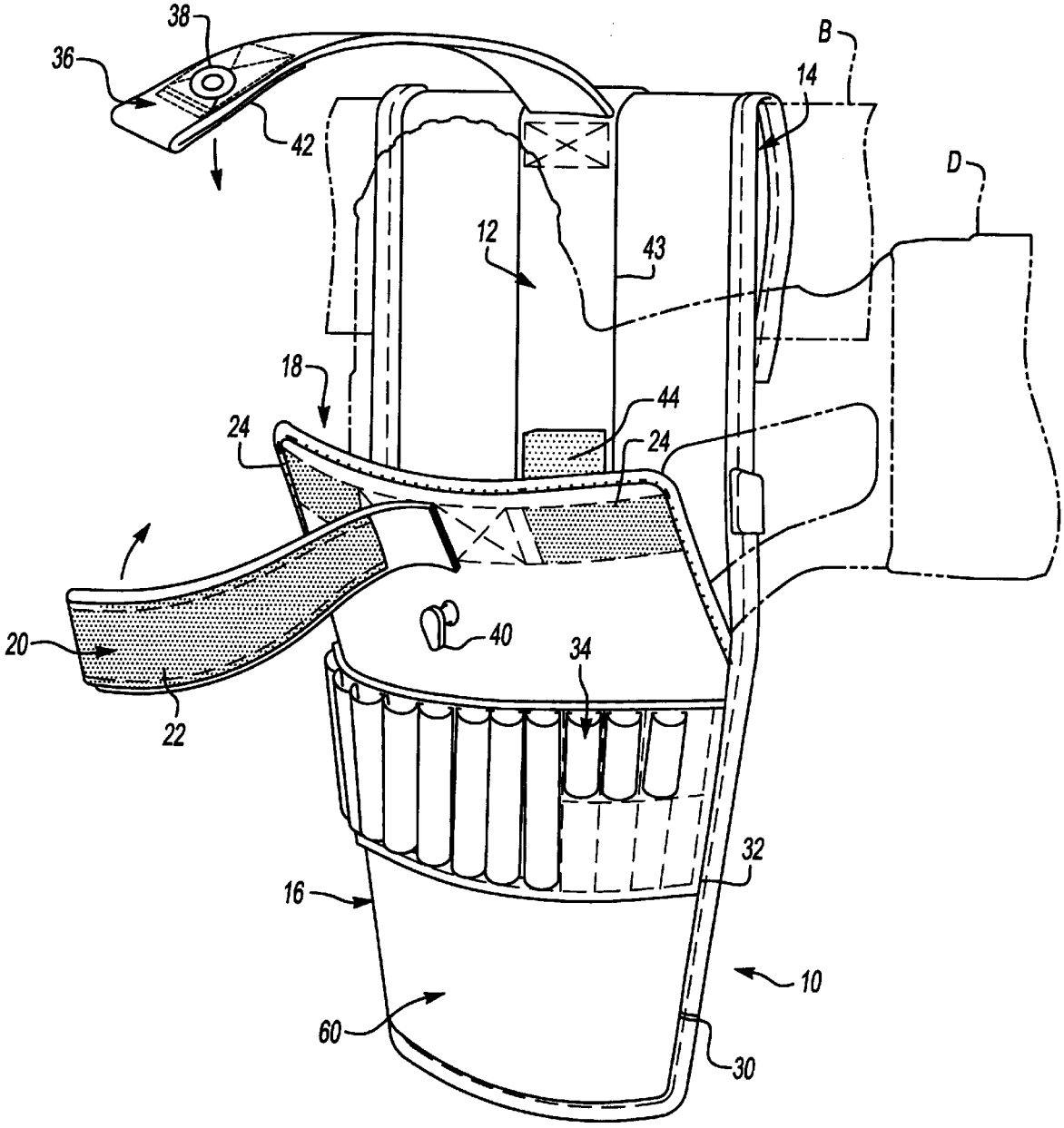
FIG. 2*b* is a perspective view of a drill holster accommodating a left-handed orientation of a drill.

As previously stated, one object of the present invention is to provide a holster that allows for an ambidextrous drill orientation. As shown in FIGS. 2*a* and 2*b*, drill D (shown in phantom) is demonstrated in both a right-handed orientation and a left-handed orientation. With reference to FIG. 2*a*, a right-handed user of a drill can naturally place the drill within the holster without changing the orientation of the handle prior to placing it within the holster. Coincidentally, FIG. 2*b* demonstrates the adaptability of the holster for a left-handed user. As previously stated with reference to FIG. 2*a*, FIG. 2*b* suggests the natural placement of the drill within the holster for a left-handed user. The various orientations of the drill expand the use of the holster to a broader range of users.

Figures 3, 3A:
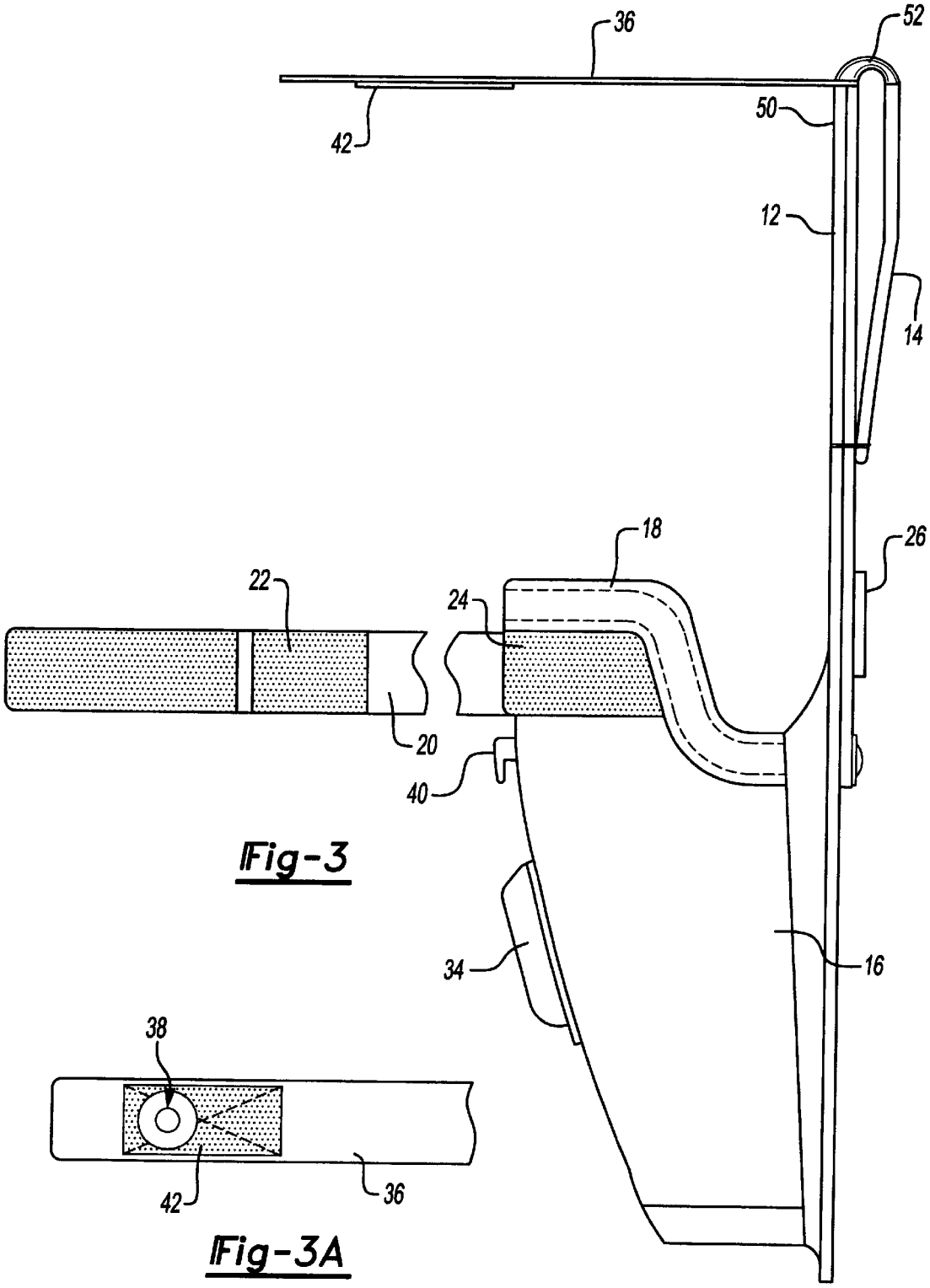
FIG. 3 is a side view of the drill holster shown in FIG. 1.
FIG. 3*a* is a detailed view of the vertical strap used with the drill holster.
Figure 7:
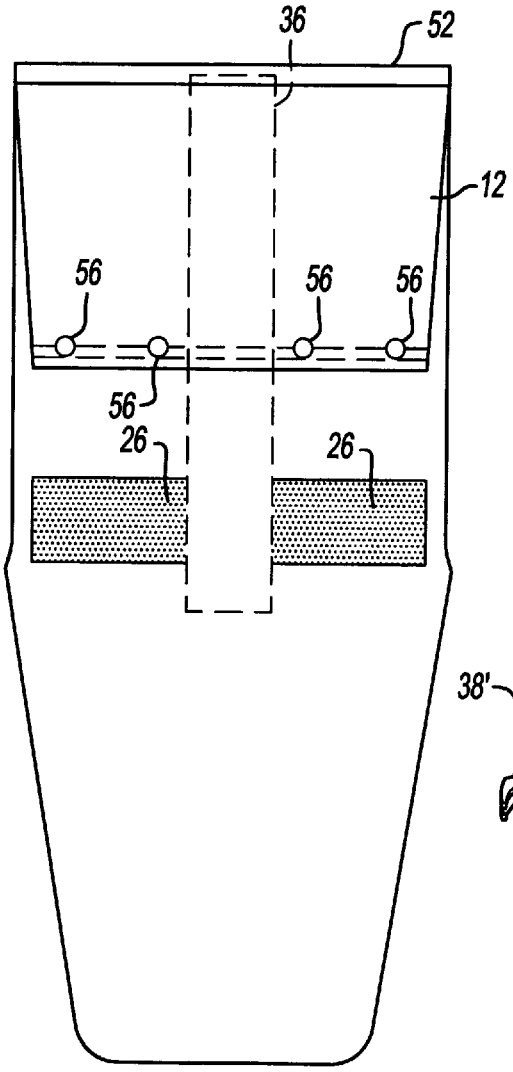
FIG. 7 is a back view of the drill holster according to the principles of the present invention.

The pocket 16 has an upper flap 18 which extends above the interface between the pocket 16 and backing 12 and extends away from the backing 12. The upper flap 18 is provided with a horizontal strap 20 extending from a front portion thereof. Strap 20 Includes a hook portion 22 of a hook and loop-type fastener on both sides thereof. A loop portion 24 of a hook and loop-type fastener is optionally provided on opposite edges of the upper flap 18. On the back side of the backing 12, loop portions 26 of a hook and loop-type fastener are also provided, as best shown in FIGS. 3 and 7. The horizontal strap 20 is utilized to further secure the drill in the holster 10 for use by a right handed or a left handed user by strapping either the front or rear edge of the upper flap 18 to the backing 12 with the horizontal strap 20 while leaving the other of the front and rear edge of the flap 18 free to accommodate the handle portion of a drill inserted into the pocket 16.

The pocket 16 is preferably sewn to the backing 12 by stitching 30 and an edge band 32, more preferably a nylon edge band. A series of accessory slots 34 is provided on the front surface of the pocket 16 for receiving drill bits and other bits that can be utilized with the drill, although various types of materials can be stored within the slots.

A vertical security strap 36 is attached to the upper portion of the backing 12. The vertical strap 36 includes an eyelet 38 which can be selectively engaged with a grommet (or over center hook) 40 provided on the nylon pocket 16. The vertical strap 36 can be utilized to secure a drill within the holster 10 by wrapping the strap 36 over the drill and engaging the eyelet 38 with the grommet 40. It should be understood that the eyelet 38 and grommet 40 can be replaced by other fasteners such as a hook and loop-type fastener or a snap-type fastener.

The vertical strap 36 is also provided with a hook portion 42 of a hook and loop-type fastener which can be selectively engaged with a loop portion of a hook and loop-type fastener that is secured to the backing 12. The backing 12 is formed with a depression 43 with the loop portion 44 of the hook and loop-type fastener (best shown in FIGS. 1 and 4) sewn at a bottom portion thereof to allow the hook portion 42 to engage the loop portion 44 so that the vertical strap 36 can be securely stored in the depression 43, out of the user's way if not used to hold a drill in the holster 10.

As described above, the drill holster 10 is primarily sewn together, however, rivets and other fastening techniques which are generally known in the art may also be utilized in place of, or in combination with, the sewn construction.

Figure 4:
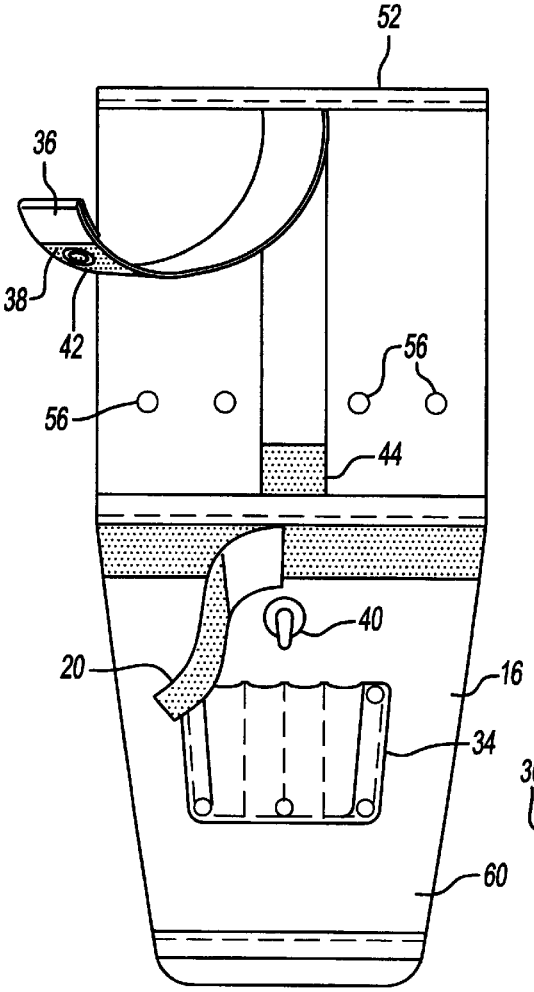
FIG. 4 is a front view of a drill holster according to a second embodiment of the present invention.
Figure 5:
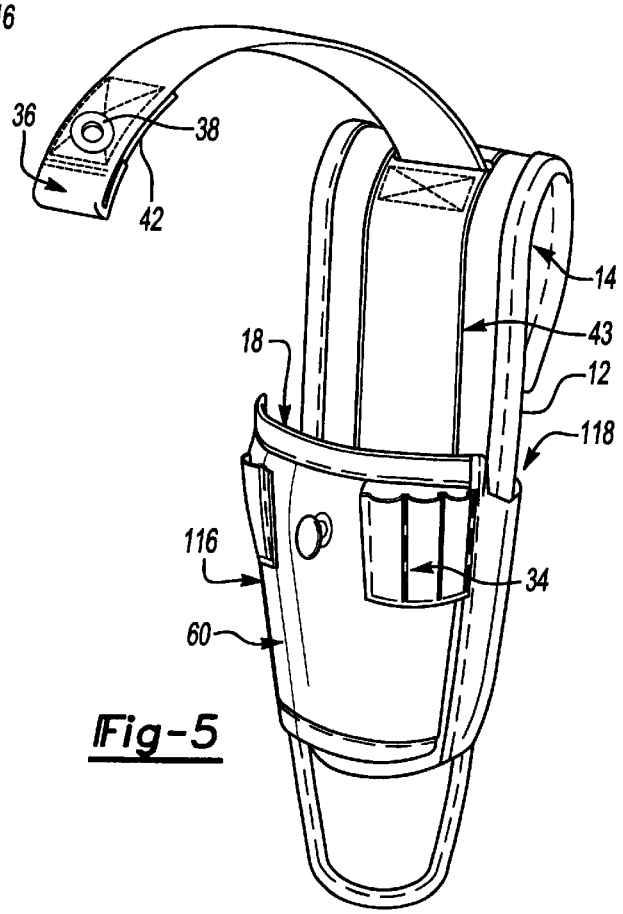
FIG. 5 is a perspective view of a drill holster according to a third embodiment of the present invention.
Figure 6A:
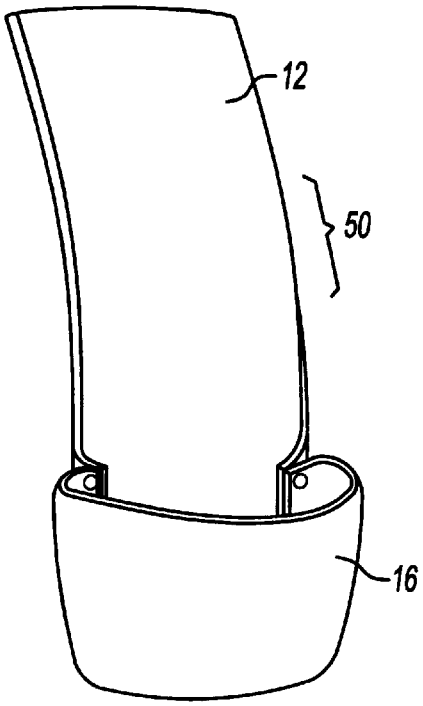
FIGS. 6*a*–6*e* illustrate the method for strengthening the tool belt loop neck.
Figure 6B:
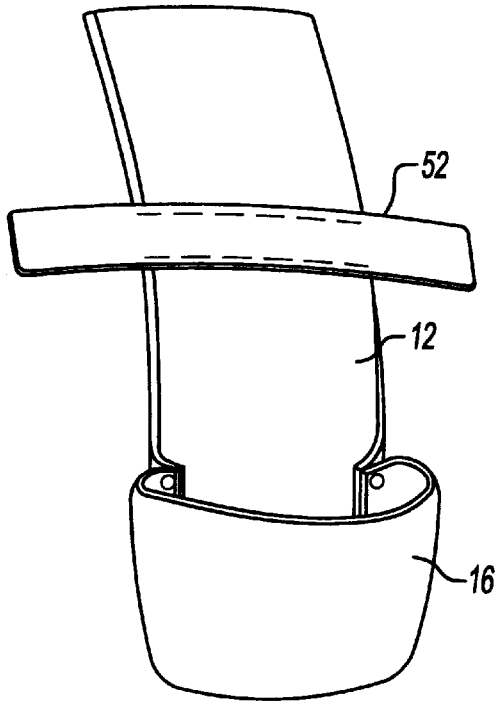
Figure 6C:
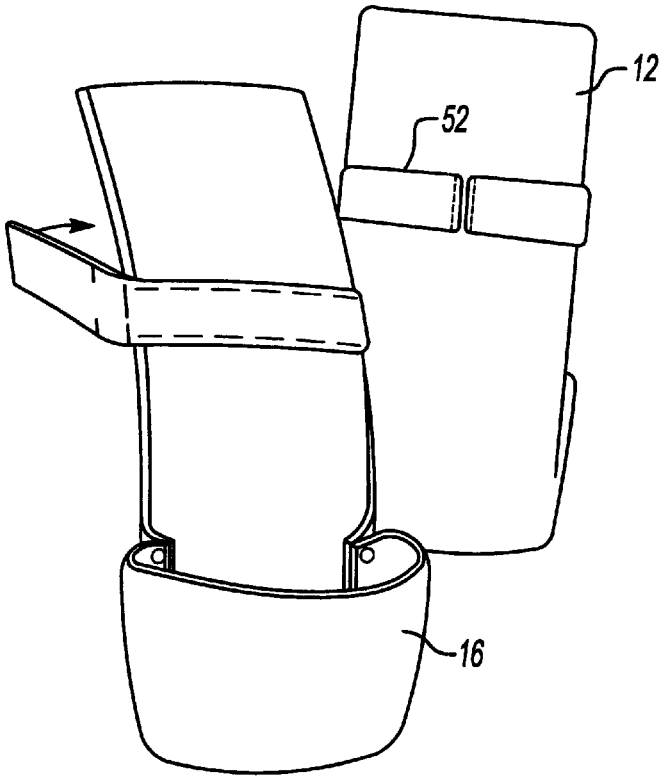
Figure 6D:
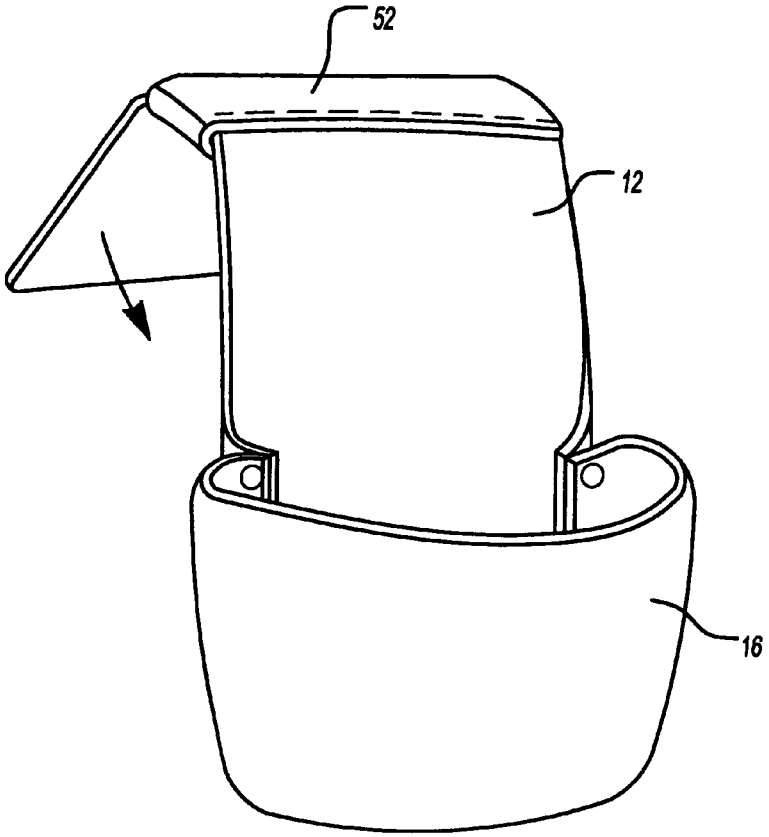
Figure 6E:
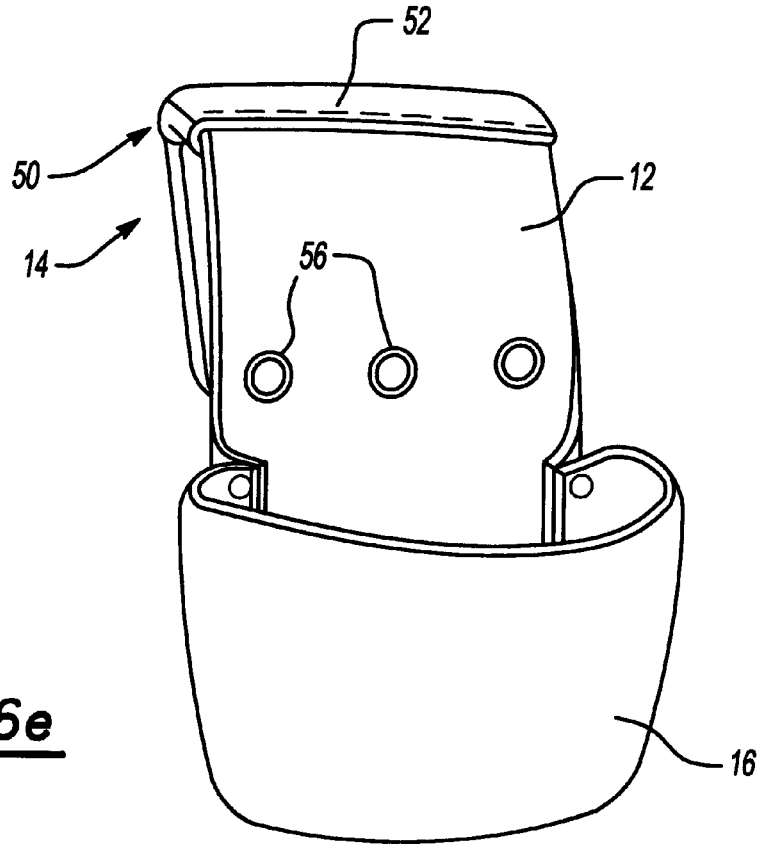

The upper portion 50 of the belt loop 14 can also be reinforced by a reinforcement webbing 52 as illustrated in FIGS. 6*a*–6*e*. The reinforcement webbing 52 is designed to strengthen the tool belt pass-through neck weight bearing region 50. As the pouch hangs from the tool belt B, the extra webbing 52 provides the needed reinforcement to an area that is susceptible to premature failure. The reinforcement webbing 52 is shown wrapped around the tool belt passthrough neck weight region or upper edge portion 50 of the belt loop 14 in FIG. 6*b* and the flaps are folded around the back edges of the backing 12 where the reinforcement webbing 52 is secured thereon by stitching (FIG. 6*c*). The backing 12 is then folded over (FIG. 6*d*) to form the belt loop portion 14 and the lower edge of the backing 12 is secured in place by rivets 56 and/or stitching (FIG. 6*e*). As shown in FIGS. 1, 4, and 5, a rubber branding badge 60 is attached to the front of the pocket 16.

Figure 8:
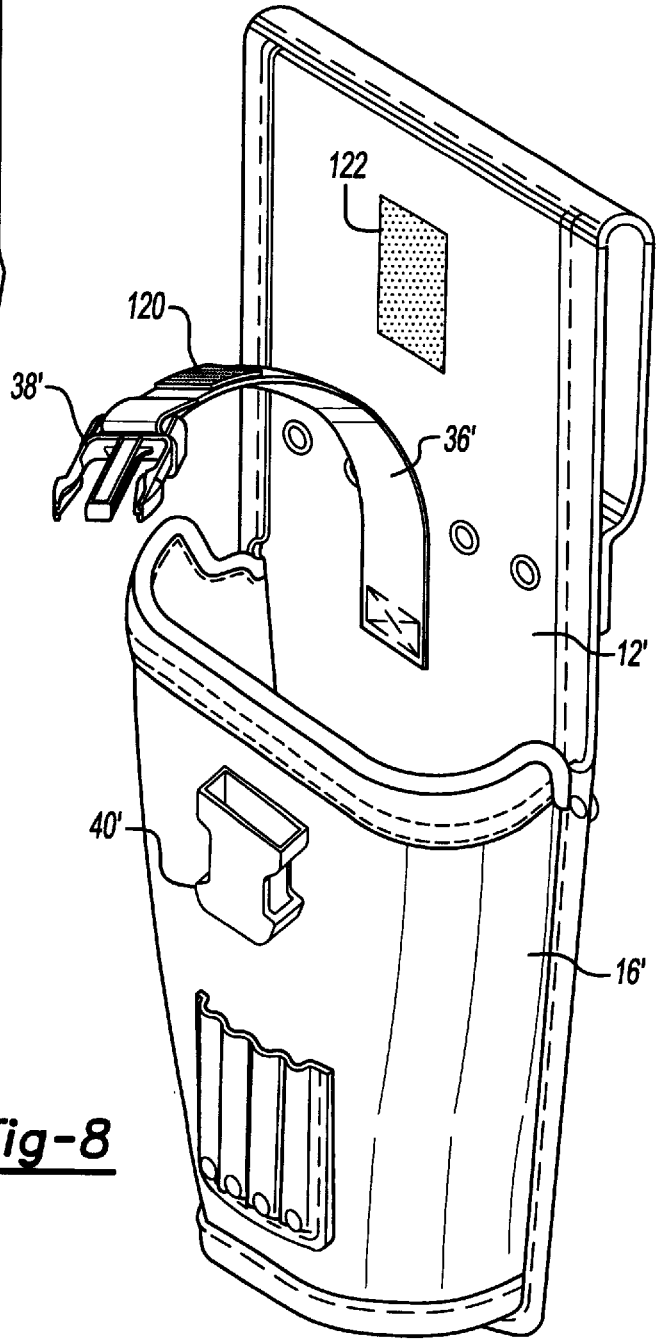
FIG. 8 is a front view of a drill holster according to a fourth embodiment of the present invention

FIGS. 4, 5, and 8 illustrate alternative embodiments which utilize different configurations of pockets and different accessory slots 34. FIG. 5 shows an ambidextrous drill holster which is provided with a cylindrical cavity pocket 116 having drop down areas 118 on opposite sides thereof. The cylindrical cavity fits snuggly against the body of the drill while the dropped down areas 118 on either side help avoid trigger misactivation. The drill holster 110 can be utilized for both right handed and left handed users. FIG. 8 illustrates an alternative strap arrangement 36' with male and female clip fasteners 38', 40' provided for releasably securing the strap 36' in a closed position for holding a drill in place. In addition, the strap 36' is connected to a middle portion of the backing member 12' so that the strap is wrapped completely around an upper portion of the drill. A first portion 120 of a hook and loop fastener is provided at an end of the strap 36' for engaging with a second portion 122 of the hook and loop fastener for securing the strap 36' out of the way of the user when the strap 36' is not being used for securing the drill in the pocket.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A holster for use with a tool belt, comprising:

a backing member defining a belt loop at an upper end thereof;

a pocket attached to said backing member; and a strap connected at one end to said pocket and being releasably connected at a second end thereof to said backing member;

wherein said second end of said strap includes a first portion of a hook and loop fastener on first and second sides thereof for selective mating engagement with a corresponding portion of a hook and loop fastener mounted on a back surface of said backing member.

2. The holster according to claim 1, wherein said pocket is attached to said backing member along at least two sides thereof, said pocket including an upper flap portion which extends beyond an opening defined between said pocket and said backing member on both sides thereof.

3. The holster according to claim 2, wherein said strap is connected to said upper flap portion.

4. The holster according to claim 3, wherein said strap is adapted to be releasably connected to said backing member on both sides of said pocket, such that said holder can be adapted for use with right and left hand users.

5. The holster according to claim 1, wherein an upper surface of said belt loop is reinforced by a webbing material.

6. The holster according to claim 1, further comprising accessory slots attached to said pocket.

7. The holster according to claim 1, further comprising a second strap having a first end attached to said backing member which is adapted to wrap over a tool inserted in said pocket for securing the tool in the holster.

8. The holster according to claim 7, wherein said backing member includes a groove in a front surface thereof for receiving said second strap in a stored position out of the way of a user.

9. The holster according to claim 7, wherein said second strap includes a first portion of a hook and loop type fastener attached to said second end thereof and a second portion of a hook and loop type fastener is attached to a front of said backing member and mates with said first portion and secures said strap out of the way of a user when not in use.

10. The holster according to claim 7, wherein said second strap includes a first fastener member attached to said second end thereof for selective engagement with a second complementary fastener member attached to said pocket.

11. The holster according to claim 7, wherein said second strap includes one of a male and a female clip fastener portion on an end thereof and said pocket includes the other of said male and female clip fastener portions thereon for selective engagement of said second strap in a closed position.

12. A holster for use with a tool belt, comprising:

a backing member defining a belt loop at an upper end thereof;

a pocket attached to said backing member along at least two sides thereof, said pocket including an upper flap portion which extends above an interface between said pocket and said backing member on both sides thereof; and a strap having a first end connected to said upper flap portion, said strap is selectively connectable to said backing member on both sides of said pocket, such that said holster can be adapted for use with right and left hand users;

wherein a second end of said strap includes a first portion of a hook and loop fastener on first and second sides thereof for selective mating engagement with a corresponding portion of a hook and loop fastener mounted on a back surface of said backing member.

13. The holster according to claim 12, further comprising a second strap connected to said backing member and connected to said pocket for securing a tool in said holder.

14. The holster according to claim 12, further comprising a webbing material connected to said backing member, wherein an upper surface of said backing member is reinforced by said webbing material.

15. A holster for use with a tool belt, comprising:

a backing member defining a belt loop at an upper end thereof;

a pocket attached to said backing member along at least two sides thereof, a strap having a first end connected to a front surface of said backing member and having a second end releasably connected to said pocket for securing a tool in said pocket;

wherein a first portion of a hook and loop fastener is connected to said second end of said strap and a second portion of a corresponding hook and loop fastener is attached to a front of said backing member for releasably securing said second end of the strap out of the way of a user.

16. The holster according to claim 15, further comprising a reinforcement material connected to said upper portion of said belt loop of said backing member so that said reinforcement material substantially covers said upper portion of said belt loop.

* * * * *